United States Patent [19]

Yoshihara

[11] Patent Number: 5,017,449

[45] Date of Patent: May 21, 1991

[54] ELECTROPHOTOGRAPHIC PHOTOSENSITIVE MEMBER WITH SUBSTITUTED NYLON INTERLAYER

[75] Inventor: Toshiyuki Yoshihara, Mitaka, Japan

[73] Assignee: Canon Kabushiki Kaisha, Tokyo, Japan

[21] Appl. No.: 468,838

[22] Filed: Jan. 19, 1990

[30] Foreign Application Priority Data

Jan. 21, 1989 [JP] Japan ..... 1-12254

[51] Int. Cl.[5] ..... G03G 5/047; G03G 5/14

[52] U.S. Cl. ..... 430/59; 430/58; 430/60; 430/64

[58] Field of Search ..... 430/58, 59, 60, 64

[56] References Cited

U.S. PATENT DOCUMENTS 3,634,079 1/1972 Champ et al. ..... 430/64 X 4,495,263 1/1985 Van der Valk ..... 430/60

FOREIGN PATENT DOCUMENTS 58-95351 6/1983 Japan ..... 430/60

60-202449 10/1985 Japan ..... 430/60

*Primary Examiner*—Roland Martin

*Attorney, Agent, or Firm*—Fitzpatrick, Cella, Harper & Scinto

[57] ABSTRACT

An electrophotographic photosensitive member comprises an electroconductive support, and at least an undercoating layer, a charge generation layer and a charge transport layer, laid successively on the electroconductive support in this order, and the undercoating layer contains N-methoxymethylated nylon 6 containing not more than 10 ppm of components having a molecular weight of not more than 1,000.

5 Claims, No Drawings

ELECTROPHOTOGRAPHIC PHOTOSENSITIVE MEMBER WITH SUBSTITUTED NYLON INTERLAYER

BACKGROUND OF THE INVENTION

1. Field of the Invention

This invention relates to an electrophotographic photosensitive member and more particularly to an electrophotographic photosensitive member having a high electrostatic contrast and a distinguished durability stability.

2. Related Background Art

Recently, a large number of electrophotographic photosensitive members using organic compounds as photoconductors have been practically used, where photoconductive substances of relatively low molecular weight are dissolved or dispersed in a resin and applied to an electroconductive support to form a film thereon and are used in the form of devices in most cases.

Such a photoconductive layer has no sufficient adhesiveness to aluminum or vapor-deposited plastic films to be generally used as an electroconductive support in most cases. When a photoconductive layer is in a lamination form of a charge generation layer and a charge transport layer laid on the charge generation layer, the charge generation layer is generally a thin layer of not more than 1 μm and thus is susceptible to influences of fine unevenness or irregularity of a support and it is difficult to form a uniform charge generation layer. Furthermore, the charge generation layer sometimes peels off due to poor adhesiveness to the support. Still furthermore, the charging characteristics of a photosensitive member is sometimes heavily deteriorated by charge injection from the support.

In order to improve the adhesiveness and film formability and prevent the charge injection, it has been practially used to provide an undercoating layer between a photoconductive layer, particularly a charge generation layer and an electroconductive support. Materials for the undercoating layer are required to be dissolved in a solvent and film-formable by application and, at the same time, not to be dissolved in such solvents as used in application of a charge generation layer and further a charge transport layer. Still furthermore, the materials, for undercoating layer must not deteriorate electrophotographic characteristics including a repetition durability. It has seen quite difficult to find materials for undercoating layer capable of satisfying all of these requirements. However, among others soluble nylons have been so far practically used owing to relatively distinguished characteristics (Japanese Patent Application Laid-Open No. 58-95351).

As one of the soluble nylons, N-methoxymethylated nylon 6, obtained by addition of a methoxymethyl group to nylon 6 is available. Electrophotographic photosensitive members comprising an undercoating layer containing the N-methyoxymethylated nylon 6, a charge generation layer and a charge transport layer succesively provided thereon have such a problem that the residual potential of electrophotographic photosensitive members is considerably increased by the physical porperties of a charge transport material.

SUMMARY OF THE INVENTION

An object of the present invention is to provide an electrophotographic photosensitive member having a low residual potential and a high electrostatic contrast.

That is, the present invention provides an electrophotographic photosensitive member, which comprises electroconductive support, and at least an undercoating layer, a charge generation layer and a charge transport layer, successively laid on the electroconductive support in this order, the undercoating layer containing N-methoxymethylated nylon 6 with not more than 10 ppm of components having a molecular weight of not more than 1,000.

Furthermore, the present invention provides an electrophotographic photosensitive member, where a charge transport material contained in the charge transport layer has an oxidation potential of not less than 0.7 eV.

DETAILED DESCRIPTION OF THE INVENTION

Generally, N-methoxymethylated nylon 6 used for the undercoating layer is nylon 6 to whose amide groups are added methoxymethyl groups by action of formaldehyde and methanol. An appropriate degree of methoxymethylation is about 30%.

Volumic resistance of the resin depends on the circumstance of atmosphere and is about $10^{12}$ to $10^{15}$ Ω.cm. That is, there is no substantial charging ability. Thus, when the resin is used as an undercoating layer of an electrophotographic photosensitive member, there is no charge to be accumulated in the undercoating layer and it is expectable that the residual potential after light irradiation is low. However, when the oxidation potential of a charge transport material to be used in a charge transport layer exceeds 0.7 eV, the residual potential considerably increases even if the undercoating layer and the charge generation layer are kept quite in the same structure.

As a result of studies on its causes, the present inventor has found that the concentration of components having a low degree of polymerization contained in N-methoxymethylated nylon 6 has a large influence thereon and has established the present invention.

Though the reasons are not thoroughly clarified yet, it seems that the work function of the undercoating layer changes by a change in the average degree of polymerization of N-methoxymethylated nylon 6, preventing the charge transport material having a high oxidation potential from carrier transfer in a low electric field.

When a charge transport material having an oxidation potential of less than 0.7 eV is used, the residual potential hardly depends on the components having a low degree of polymerization contained in N-methoxymethylated nylon 6. However, it is known that charge transport materials having a low oxidation potential are readily deteriorated in a corona discharge circumstance used in the electrophotographic process, and in order to obtaine an electrophotographic photosensitive member, having a satisfactory durability, it is required to use a charge transport material having a high oxidation potential. Thus, the present electrophotographic photosensitive member provides an indispensable technique for establishing a highly durable photosensitive member.

In order to lower the concentration of components having a molecular weight of not more than 1,000 in N-methoxymethylated nylon 6, it is preferable in the present invention to make reprecipitation by dropwise adding a solution of the nylon 6 to a solvent which does not dissolve components having a molecular weight of more than 1,000. A preferable solvent includes, for example, ketones such as acetone, methylethylketone, etc., water, etc.

In forming an undercoating layer, the resin may be blended with such resins as nylon copolymer, etc. in view of the point of the solvent resistance in lamination or for the purpose of controlling the resistance.

The thickness of the undercoating layer is 0.1 to 5 μm, preferably 0.3 to 2 μm. Below 0.1 μm, the function required for the undercoating layer is not thoroughly obtained. Above 5 μm, a charging ability appears, and thus this is not preferable.

Specific embodiments of the present electrophotographic photosensitive member will be described below, referring to a case of laminating an electroconductive support with a charge generation layer and a charge transport layer in this order.

A support having an electroconductive layer includes supports having an electroconductivity by themselves, such as aluminum, aluminum alloy, copper, zinc, stainless steel, vanadium, molybdenum, chromium, titanium, nickel, indium, gold, platinum, etc., plastics having a layer of aluminum, aluminum alloy, indium oxide, tin oxide, indium oxide-tin oxide alloy or the like formed by vacuum vapor deposition, supports of plastics or paper impregnated with electroconductive particles, plastics having an electroconductive polymer layer, etc.

It is preferable to provide an electroconductive layer between the support and the undercoating layer to cover the unevenness or defects of the support or prevent interference fringes due to scattering in the case that the image input is made by a laser beam. The electroconductive layer can be formed by dispersing electroconductive powders of carbon black, metallic powders, metal oxides, etc. in a binder resin. The thickness of the electroconductive layer is 5 to 40 μm, preferably 10 to 30 μm.

A charge generation layer is formed by applying a coating solution of a charge generation material such as pyrylium-based dye, thiapyrylium-based dye, phthalocyanine-based pigment, anthoanthrone pigment, dibenzpyrenequinone pigment, pyranthron pigment, azo-based pigment, indigo-based pigment, quinacridone-based pigment, quinocyanine, etc., dispersed in an appropriate binder solution to the undercoating layer. The thickness of the charge generation layer is 0.05 to 10 μm, preferably 0.1 to 3 μm.

As a charge transport material, it is preferable to select a material having an oxidation potential of not less than 0.7 eV from the ordinary materials such as pyrazoline-based compounds, hydrazone-based compounds, stilbenzene-based compounds, triphenylamine-based compounds, benzidine-based compounds, oxazole-based compounds, etc.

The oxidation potential of the charge transport material shows a peak value (Eox) of first oxidation wave and can be actually determined by cyclic voltametry using methanol, ethanol, acetonitrile, etc. as a solvent, such a salt as tetra-n-butylammonium perchlorinate, lithium perchlorinate, tetraethylammonium p-toluenate, etc. as a support electrolyte, a saturated calomel electrodes as a reference electrode, and platinum as a counter electrode and a working electrode. The determination is not limited to the cyclic voltametry, and can be made by potentiometry or polarography.

In the present invention, the oxidation potential was determined by cyclic voltametry using acetonitrile as a solvent, tetra-n-butylammonium perchlorate as a support electrolyte.

A coating solution of the above-mentioned charge transport material in an appropriate binder solution is applied to the charge generation layer. The thickness of the charge transport layer is 5 to 40 μm, preferably 10 to 30 μm.

Application of these respective layers can be made by a known method such as dipping, spraying, beam coating, blade coating, spinner coating, etc. (Reprecipitation of N-methoxymethylated nylon 6)

20 g of commercially available N-methoxymethylated nylon 6 (Toresin EF-30T, trademark of a product made by Teikoku Kagaku Sangyo K. K. Japan) was dissolved in 200 g of methanol. To 250 g of acetone was dropwise added to the solution of N-methoxymethylated nylon 6 with stirring over about 40 minutes to conduct reprecipitation.

The resulting precipitates were recovered on a Nutsuche-type aspirating funnel, washed with acetone and dried in vacuum at 80° C. overnight.

Determination of components having a molecular weight of not more than 1,000 was made as follows.

N-methoxymethylated nylon 6 was subjected to determination by gel permeation chromatography, which will be hereinafter referred to as GPC, before and after the reprecipitation treatment under the following conditions:

Apparatus: high speed liquid chromatograph 244, made by Waters Co., Ltd.

Column: polystyrene gels $10^5$Å, $10^4$Å, $10^3$Å and 200Å (total: four columns)

Sample solution: 0.5% N-methoxymethylated nylon 6(Toresin EP-30 T) in trifluoroethanol Injection amount: 200 μl Flow rate: 1 ml/min Temperature: 45° C.

Detector: differential refractometer

Calibration: calibration was made with a solution of polymethylmethacrylate calibrated with standard polystyrene in trifluoroethanol.

Concentration of components having a molecular weight of not more than 1,000 was determined from an area intensity of GPC chromatogram.

As a result, it was found that the concentration of components having a molecular weight of not more than 1,000 was 250 ppm in the resin before the reprecipitation, but there were no such components at all after the reprecipitation.

On the other hand, the removed components were recovered from the acetone after the reprecipitation treatment and quantitatively determined. It was found that the concentration of the removed components was 280 ppm, which is approximate to the GPC result.

EXAMPLE 1

An aluminum cylinder, 30 mm in diameter and 260 mm long, was used as a support.

An electroconductive layer of the following composition was applied to the support by dipping, where parts are by weight:

Electroconductive pigment: tin oxide-coated titanium oxide (Cromos ECT-62, trademark of a product made by Titan Kogyo K. K., Japan) 10 parts Resistance-adjusting pigment: titanium oxide (Titone SR-1T, a product made by Sakai Kagaku K. K. Japan) 10 parts Binder resin: phenol resin(J-325, trademark of a product made by Dainippon Ink Kagaku Kogyo K. K. Japan) 10 parts Surface-roughening agent: spherical silicone resin powder (Tospal 120, trademark of a product made by Toshiba Silicone K. K. Japan) 1.5 parts Solvent: methanol/methylcellosolve (1:1) 20 parts The applied layer was cured by heating at 140° C. for 30 minutes to form a scattering-preventing electroconductive layer having a thickness of 18 μm.

Then, a coating solution was prepared by dissolving 7 parts of the above-mentioned reprecipitated N-methoxymethylated nylon 6 and 3 parts of nylon copolymer for resistance adjustment (CM-8000, trademark of a product made by Toray K. K. Japan) in 60 parts of methanol and 30 parts of n-butanol and applied to the electroconductive layer by dipping to form an undercoating layer having a thickness of 1.5 μm.

Then, a coating solution was prepared by dispersing 10 parts of a tris-azo pigment having the following structural formula:

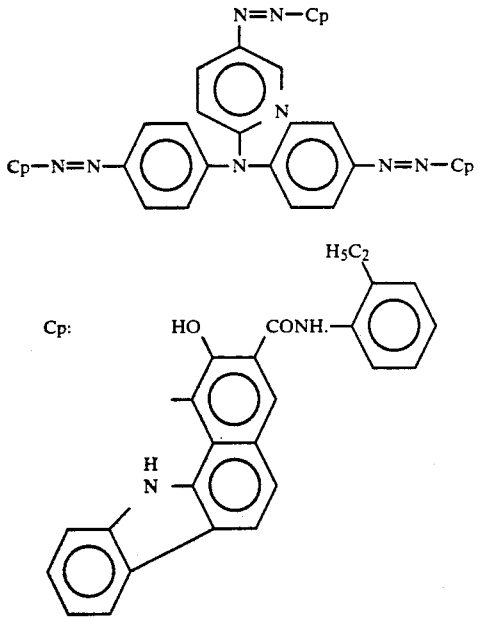

and 4 parts of polyvinylbutyral C S-lec BL-S, trademark of a product made by Sekisui Kagaku Kogyo K. K. Japan) in 200 parts of cyclohexanone in a sand mill using glass beads, 1 mm in diameter, for 30 hours, and adding 300 to 450 parts (optionally) of tetrahydrofuran thereto. It was applied to the undercoating layer to form a charge generation layer having a thickness of 0.15 μm.

Then, a coating solution was prepared by dissolving 10 parts of a stilbenzene compound having the following structural formula:

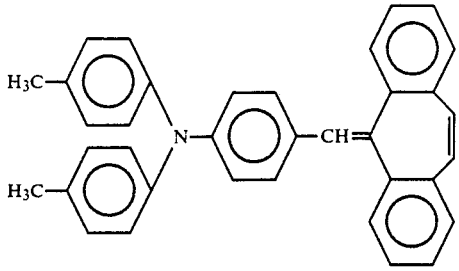

and 10 parts of bisphenol Z type polycarbonate in 55, parts of chlorobenzene. It was applied to the charge generation layer to form a charge transport layer having a thickness of 19 μm. The oxidation potential of the stylbenzene compound was 0.81 eV.

In this manner, an electrophotographic photosensitive member was prepared.

COMPARATIVE EXAMPLE 1

An electrophotographic photosensitive member was prepared in the same manner as in Example 1, except that N-methoxymethylated nylon 6 without the reprecipitation treatment was used.

The electrophotographic photosensitive members prepared in Example 1 and comparative Example 1 were mounted on an electrophotographic laser printer using a semiconductor laser as a light source, and the dark potential $V_D$ was set to −700 V. A light potential $V_L$ and a residual potential $V_R$ were determined by setting a light quantity of 785 nm imagewise exposure laser to 2.0 μJ/cm² and a light quantity of decharging light exposure to 6 lux. sec. The circumstance for the determination was 23° C. and 55%RH. The following results were obtained.

| Photosensitive member | Initial | After 5,000 printings |
|---|---|---|
| Example 1 | −180 V/−20 V | −170 V/−20 V |
| Comparative Example 1 | −230 V/−80 V | −280 V/−130 V |

When N-methoxymethylated nylon 6 containing low molecular weight components was used for an undercoating layer (Comparative Example 1) the residual potential and light potential were increased and the potentials were further increased by repeated printings, whereas the present photosensitive member of Example 1 had a stable and high contrast.

EXAMPLE 2

An aluminum cylinder with the mirror-finished surface, 80 mm in diameter and 360 mm long, was used as a support.

A coating solution for undercoating layer having the same composition as in Example 1 was applied to the support to form an undercoating layer having a thickness of 0.7 μm.

Then, a coating solution was prepared by dispersing 10 parts of a disazo pigment having the following structural formula:

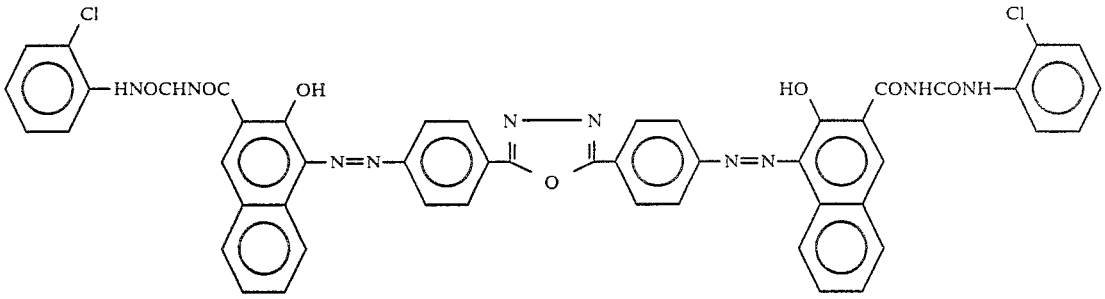

and 4 parts of polyvinylbutyral C S-lec BM-2, trademark of a product made by Sekisui Kagaku Kogyo K. K. Japan) in 300 parts of cyclohexanone in a sand will using glass beads, 1 mm in diameter, for 20 hours, and 200 to 350 parts (optionally) of tetrahydrofuran was added thereto. Then, the coating solution was applied to the undercoating layer to form a charge generation layer having a thickness of 0.13 μm.

Then, a coating solution was prepared by dissolving 10 parts of a benzcarbazole compound having the following structural formula:

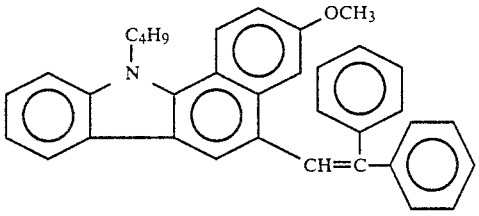

and 10 parts of bisphenol Z type polycarbonate in 55 parts of chlorobenzene and applied to the charge generation layer to form a charge transport layer having a thickness of 20 μm. The oxidation potential of the benzcarbazole compound was 0.88 eV.

In this manner, an electrophotographic photosensitive member was prepared.

EXAMPLE 3

An electrophotographic photosensitive member was prepared in the same manner as in Example 2, except the reprecipitated N-methoxymethylated nylon 6 doped with 10 ppm of low molecular weight components separated by the reprecipitation was used in the coating solution for undercoating layer of Example 2.

COMPARATIVE EXAMPLE 2

An electrophotographic photosensitive member was prepared in the same manner as in Example 2, except that the reprecipitated N-methoxymethylated nylon 6 doped with 30 ppm of low molecular weight components separated by the reprecipitation was used in the coating solution for undercoating layer of Example 2.

The electrophotographic photosensitive members prepared in Examples 2 and 3 and Comparative Example 2 were mounted in a plain paper copying machine and $V_D$ was set to −650 V. $V_L$ and $V_R$ were determined by setting a light quantity of decharging light exposure by a halogen lamp to 2.2 lux. sec. and a light quantity of decharging light exposure by a fuse lamp to 6 lux.sec. The results are given below:

| Photosensitive member | Initial | After 10,000 printings |
|---|---|---|
| Example 2 | −150 V/−20 V | −160 V/−30 V |
| Example 3 | −160 V/−30 V | −170 V/−40 V |
| Comparative Example 2 | −180 V/−50 V | −240 V/−120 V |

What is claimed is:

1. An electrophotographic photosensitive member, which comprises an electroconductive support, and at least an undercoating layer, a charge generation layer and a charge transport layer, laid successively on the electroconductive support in this order, the undercoating layer containing N-methoxymethylated nylon 6 containing not more than 10 ppm of components having a molecular weight of not more than 1,000.

2. An electrophotographic photosensitive member according to claim 1, wherein a charge transport material contained in the charge transport layer has an oxidation potential of not less than 0.7 eV.

3. An electrophotographic photosensitive member according to claim 2, wherein the charge transport material is selected from the group consisting of pyrazoline-based compounds, hydrazone-based compounds, stilbenzene-based compounds, triphenylamine-based compounds, benzidine-based compounds and oxazole-based compounds.

4. An electrophotographic photosensitive member according to claim 1, wherein the charge generation layer is a layer of a charge generation material selected from the group consisting of pyrylium-based dye, thiapyrylium-based dye, phthalocyanine-based pigment, anthoanthrone pigment, dibenzpyrenequinone pigment, pyranthron pigment, azo-based pigment, indigo-based pigment, quinacridone-based pigment and quinocyanine-based pigment, disposed in an appropriate binder solution.

5. An electrophotographic photosensitive member, which comprises an electroconductive support, and at least an undercoating layer, a charge generation layer and a charge transport layer, laid successive on the electroconductive support in this order, the undercoating layer containing N-methoxymethylated nylon 6 reprecipitated with methanol and acetone.

* * * * *